United States Patent [19]

Usbeck

[11] 4,211,619

[45] Jul. 8, 1980

[54] PROCESS FOR ANODICALLY OXIDIZING ALUMINUM AND USE OF THE MATERIAL SO PREPARED AS A PRINTING PLATE SUPPORT

[75] Inventor: Gerhard Usbeck, Wiesbaden, Fed. Rep. of Germany

[73] Assignee: Hoechst Aktiengesellschaft, Fed. Rep. of Germany

[21] Appl. No.: 20,076

[22] Filed: Mar. 13, 1979

[30] Foreign Application Priority Data

Mar. 16, 1978 [DE] Fed. Rep. of Germany ..... 2811396

[51] Int. Cl.[2] ..... C25D 11/16; C25D 11/18

[52] U.S. Cl. ..... 204/33; 204/38 A; 204/58

[58] Field of Search ..... 204/33, 35 N, 58, 129.75, 204/1.7, 38 A

[56] References Cited

U.S. PATENT DOCUMENTS 3,902,976 9/1975 Walls ..... 204/38 A 3,935,080 1/1976 Gumbinner ..... 204/33

4,144,142 3/1979 Takahashi ..... 204/58

FOREIGN PATENT DOCUMENTS 679599 9/1952 United Kingdom ..... 204/58

*Primary Examiner*—T. M. Tufariello

*Attorney, Agent, or Firm*—James E. Bryan

[57] ABSTRACT

This invention relates to an improvement in the process for anodically oxidizing materials in the form of strips, foils, or plates comprised of aluminum or aluminum alloys in an aqueous electrolyte containing sulfuric acid and aluminum ions, if appropriate, after a foregoing mechanical, chemical, or electrochemical roughening, the improvement comprising anodically oxidizing the material in an electrolyte having a concentration of sulfuric acid in the range of about 25 to 100 g per liter and of aluminum ions in the range of about 10 to 25 g per liter, at a current density in the range of about 4 to 25 A/dm$^2$, and a temperature in the range of about 25° to 65° C.

4 Claims, No Drawings

PROCESS FOR ANODICALLY OXIDIZING ALUMINUM AND USE OF THE MATERIAL SO PREPARED AS A PRINTING PLATE SUPPORT

This invention relates to a process for anodically oxidizing aluminum, to the use of the material prepared according to this process as a printing plate support, and to a method for the manufacture of a printing plate support material.

During the past decades a tendency towards a steady improvement of the material surfaces has been observed in the processing of aluminum or aluminum alloys, e.g. in the form of strips, foils, or plates, in order to prepare these surfaces for the most diversified applications. Among the different properties which are desired with respect to the surface are: corrosion resistance, appearance, density, hardness, abrasion resistance, receptivity and adhesion to lacquer or synthetic resin coatings, receptivity to dyes, gloss, etc. Based on bright-rolled aluminum, development took its course over chemical, mechanical, and electrochemical methods for the surface treatment, and, in practice, combinations of the various methods also are being employed.

Particularly in the processing of materials of this kind in the form of strips, foils, or plates comprised of aluminum or aluminum alloys, which are to be used as support materials for (planographic) printing plates, technical development, has, for the time being, found its conclusion in a generally accepted combination of a usually mechanical or electrochemical roughening step with an ensuing treatment by anodic oxidation of the roughened aluminum surface. Depending upon the desired number of prints to be made from the treated printing plate, anodic oxidation procedures also may be performed on aluminum materials which have not been subjected to a separate roughening treatment. In this case, the surfaces of the materials merely must be such that an adhesive aluminum oxide layer can be applied by anodic oxidation.

Anodic layers on (planographic) printing plates help, above all, to improve hydrophilic properties and to increase resistance to abrasion and thus, for example, to prevent a loss of printing areas on the surface during the printing operation, and, in addition, they provide, for example, for an improved adhesion of the light-sensitive layer.

On account of their natural porosity, conventional anodic layers have, however, some disadvantages. Depending upon the anodizing conditions, they have an increased sensitivity to alkali which may, for example, be contained in the usual compositions used for developing the light-sensitive layers or in the fountain solution, and they also show a more or less strong irreversible absorption of substances contained in the applied coating. This absorption may give rise to the so-called "staining", i.e., to a discoloration of the oxide layer, which becomes visible in the image-free areas of the printing plate following development of the exposed light-sensitive layer. This "staining" shows particularly clearly if a chemical correction is carried out, which is frequently necessary, for example, in order to remove film edges on the printing image. In this case, the substances which cause "staining" are dissolved even deep out of the oxide layer, so that the corrected zones appear as light areas upon a toned background. In the most unfavorable case, the sensitivity to alkali and the correction marks mentioned result in difficulties in printing, which may become apparent as a scumming propensity of the printing plates in their image-free areas and as a reduction of the length of printing runs obtained with the printing plates.

From the prior art the following two standard methods for the anodic oxidation of aluminum in aqueous electrolytes containing $H_2SO_4$ are known (see for example, M. Schenk: "Werkstoff Aluminum und seine anodische Oxydation", Francke Verlag, Bern, 1948, page 760: "Praktische Galvanotechnik", Eugen G. Leutze Verlag, Saulgau, 1970, page 395 et seq. and pages 518/519; W. Hübner and C. T. Speiser: "Die Praxis der anodischen Oxidation des Aluminiums", Aluminum Verlag, Düsseldorf, 1977, 3rd Edition, page 137 et seq.), with $H_2SO_4$ having proved to be the most useful electrolytic acid for most applications.

1. DIRECT CURRENT-SULFURIC ACID PROCESS:

In this process an aqueous electrolyte is used which normally contains 231 g of $H_2SO_4$ per liter of solution, and the anodic oxidation is carried out during 10 to 60 minutes at a temperature of from 10° to 22° C. and a current density of from 0.5 to 2.5 A/dm$^2$. The concentration of sulfuric acid in the aqueous electrolyte solution may be reduced to 8 to 10 percent by weight of $H_2SO_4$ (approximately 100 g of $H_2SO_4$ per liter) or increased to 30 percent by weight (365 g of $H_2SO_4$ per liter) or more. Due to the $Al^{3+}$ ions formed from Al atoms during the anodic oxidation, there is always a particular proportion of $Al^{3+}$ ions in the aqueous electrolyte containing $H_2SO_4$, and this proportion is kept as stable as possible, in order to obtain reproducible results with respect to the properties of the layer. A stable concentration of $Al^{3+}$ ions is achieved by continuously regenerating the electrolyte, so that the content of $Al^{3+}$ ions is maintained in the range between about 8 and about 12 g of $Al^{3+}$ per liter. An aqueous electrolyte which contains $H_2SO_4$ and is suitable for the process in question is depleted at the latest when it contains about 15 to 18 g of $Al^{3+}$ per liter. Values exceeding 12 g of $Al^{3+}$ per liter are, if possible, avoided in practice.

2. "HARD ANODIZING":

This process is carried out in an aqueous electrolyte containing $H_2SO_4$ and having a concentration of 166 g of $H_2SO_4$ per liter (or 231 g of $H_2SO_4$ per liter), at an operating temperature of 0° to 5° C., a current density of from 2 to 3 A/dm$^2$, and a rising voltage amounting to about 25 to 30 V at the beginning and to about 40 to 100 V towards the end of the treatment which takes from 30 to 200 minutes.

For many fields of application the two above-mentioned processes provide suitable oxide layers on aluminum, however, when used, for example, for the preparation of support materials for printing plates they exhibit some disadvantages. These include, on the one hand, an increased sensitivity to alkali of the layers so produced and "staining" and, on the other hand, particularly in "hard anodizing", the energy which has to be applied to attain and keep constant the low temperatures of the electrolyte, and the dwell times of the aluminum in the electrolyte, which are relatively long for the economically favorable continuous anodization of aluminum.

In addition, some modified anodizing processes are known from the prior art, which either propose special modifications of the anodizing conditions or of the compositions of the electrolytic baths. The following publications may, for example, be mentioned in this connection:

In German Offenlegungsschrift No. 1,496,711, a process for the anodic oxidation, among others, of aluminum is described, in which the workpieces are anodized in an aqueous electrolyte containing $H_2SO_4$ and having a temperature not exceeding 20° C., by applying a current density of more than 20 A/dm$^2$, appropriately, however, of more than 80 A/dm$^2$, and by simultaneously super-cooling the workpieces.

The process of German Offenlegungsschrift No. 2,328,606, for the anodic oxidation of printing plate support materials composed of aluminum is carried out in an aqueous electrolyte containing about 15 percent by weight of $H_2SO_4$ (about 165 g of $H_2SO_4$ per liter), at a temperature exceeding 70° C., a current density ranging from 16.1 A/dm$^2$ to 108 A/dm$^2$, and during 10 to 60 seconds. The anodic oxidation may be preceded by electrochemical roughening, or it may be followed by a further chemical treatment step.

Based on the problem of "staining" encountered in conventional anodic oxidation processes (see "direct current—sulfuric acid process" mentioned above) German Offenlegungsschrift No. 2,248,743, describes an aqueous electrolyte containing $H_2SO_4$ which is used for the preparation of support materials for printing plates. This electrolyte contains about 10 to 35 percent by weight of $H_2SO_4$ (about 106 to 435 g of $H_2SO_4$ per liter); it is applied at temperatures of from 20° to 40° C. and a current density of from 4 to 15 A/dm$^2$ and impinges upon the aluminum strip at a relative linear speed of at least 2 m/minute.

From Swiss Pat. No. 171,733 a process for the anodic oxidation of aluminum is known, in which an aqueous electrolyte containing from 35 to 60 percent by weight of $H_2SO_4$ (i.e. more than 435 g of $H_2SO_4$ per liter) is employed at a current density ranging from 0.32 to 1.08 A/dm$^2$, at a temperature from 18° to 30° C. and with an addition from 2 to 3% of aluminum sulfate (about 1.6 to 2.4 g of $Al^{3+}$ per liter).

Swiss Patent No. 161,851, proposes a process for the anodic oxidation of aluminum, which is carried out during 15 to 50 minutes in an aqueous electrolyte, for example, composed of 900 g of aluminum sulfate (about 3.95 g of $Al^{3+}$ per liter), 13.5 l of $H_2O$, and 4.5 l of $H_2SO_4$ (about 450 g of $H_2SO_4$ per liter), at a current density from 0.1 to 0.35 A/dm$^2$, and a temperature from 15° to 32° C.

According to German Auslegeschrift No. 1,257,532, a process for the generation of a corrosion-resistant layer of high abrasion resistance on aluminum alloys containing about 6% of Cu is carried out during about 30 minutes in an aqueous electrolyte containing from 240 to 300 g $H_2SO_4$ per liter and at least 50 g of $Al_2O_3$ per liter (about 27 g of $Al^{3+}$ per liter), at a current density from 1 to 12 A/dm$^2$.

According to German Offenlegungsschrift No. 1,233,472, hard layers having thicknesses from 100 to 180 μm are produced on aluminum during 1 to 2.5 hours at temperatures ranging from about 15° C. to about 20° C., in a bath composed from 250 to 300 g of aluminum sulfate per liter, from 30 to 40 g of oxalic acid per liter, and from 7 to 20 g of glycerol per liter, at a current density from 2.5 to 3 A/dm$^2$.

From German Offenlegungsschrift No. 2,251,710 (corresponding to British Patent No. 1,410,768) a process for the preparation of support materials for printing plates is known, in which, for example, a flat aluminum plate is mechanically roughened, and is then anodically oxidized during 6 minutes in an aqueous electrolyte composed of 30% of $H_2SO_4$ (about 365 g of $H_2SO_4$ per liter) and 20 g of aluminum sulfate per liter (about 1.6 g of $Al^{3+}$ per liter), at a current density of 4 A/dm$^2$.

All of the processes hitherto proposed are, however, either suitable only for the production of thick aluminum oxide layers or they provide layers which, particularly, cannot fulfill the requirements which must be met by a support for (planographic) printing plates.

It is, therefore, an object of the present invention to propose a process for the preparation of anodically oxidized aluminum, which is adapted to produce abrasion-resistant, alkali-resistant, low-porosity aluminum oxide layers of sufficient thickness on aluminum strips, foils, or plates, at a reasonable expenditure of energy.

The present invention is based on the known process for anodically oxidizing strip, foil, or plate-shaped materials composed of aluminum or aluminum alloys, in an aqueous electrolyte containing sulfuric acid and aluminum ions, if appropriate, after a fore-going mechanical, chemical or electrochemical roughening. In the inventive process the material is anodically oxidized in an electrolyte having a concentration from 25 to 100 g of sulfuric acid per liter and from 10 to 25 g of aluminum ions per liter, at a current density ranging from 4 to 25 A/dm$^2$ and a temperature ranging from 25° to 65° C. In a preferred embodiment, the process having the above-mentioned features serves to prepare a support material for printing plates in the form of strips, foils, or sheets. In the following, the term "printing plate" is generally meant to denote a printing plate for planographic printing, mainly composed of a planar support of one or more materials and one or more likewise planar light-sensitive layers applied to the support.

The two processes are preferably carried out in an electrolyte having a concentration from 30 to 75 g of sulfuric acid per liter, from 15 to 20 g of aluminum ions per liter, and at a current density ranging from 6 to 15 A/dm$^2$, and a temperature ranging from 40° to 55° C.

As the metal base constituting the strip, foil, or sheet-shaped material aluminum or an aluminum alloy is used. The preferred materials (which are also used in the examples below) are:

"Pure Aluminum" (German Industrial Standard Material-DIN-Werkstoff No. 3.0255) comprising ≧99.5% of Al and the following permissible impurities (total 0.5% max.): Si 0.3%, Fe 0.4%, Ti 0.03%, Cu 0.02%, Zn 0.07%, and others 0.03%, or "Al-Alloy 3003" (comparable to German Industrial Standard Material-DIN-Werkstoff No. 3.01515) comprising ≧98.5% of Al and as alloying elements: Mg 0 to 0.3% and Mn 0.8 to 1.5%, and the following permissible impurities: Si 0.5%, Fe 0.5%, Ti 0.2%, Zn 0.2%, Cu 0.1%, and others 0.15%.

The electrolyte is prepared from concentrated $H_2SO_4$, water, and an added aluminum salt, particularly aluminum sulfate, in such a manner that it contains, per liter of the electrolyte, from 25 to 100 g of $H_2SO_4$, preferably from 30 to 75 g of $H_2SO_4$, and from 10 to 25 g of dissolved $Al^{3+}$ ions, preferably from 15 to 20 g of $Al^{3+}$ ions. The ranges of concentration of the electrolyte components are checked at regular intervals, because they are decisive for optimum process conditions. The electrolyte is then discontinuously or, preferably, continuously regenerated. A detailed description of the preparation, control and regeneration of the electrolytes in the anodic oxidation of aluminum is given in "Die Praxis der anodischen Oxidation des Aluminiums" by W. Hübner and C. T. Speiser, Aluminum Verlag, Düsseldorf, 1977, 3rd Edition, pages 141 to 148 and 154 to 157. This publication also contains fundamental information on the mode of operation in the anodic oxidation of aluminum (pages 149 to 150).

The process according to the invention may be performed discontinuously or, preferably, continuously. An apparatus which is suitable for carrying out the continuous process is, for example, described in German Auslegeschrift No. 2,234,424 (corresponding to U.S. Pat. No. 3,871,982). This apparatus comprises a treatment tank filled with the electrolyte, one inlet and outlet aperture each for the metal strip to be treated provided in the two end walls of the tank below the liquid level of the electrolyte, at least one electrode arranged above the metal strip, and means for producing a rapid flow of the electrolyte between the path of travel of the strip and the electrode surface. The flow of the electrolyte is produced by a bell-shaped chamber each, arranged close to each end wall of the treatment tank, the bell chamber having an overflow for the electrolyte with a liquid drain pipe leading into a reserve container disposed below the treatment tank, a gas space isolated from the ambient atmosphere above the liquid level, and a gas discharge pipe leading out of this gas space and connected with a suction pump. In addition, the apparatus is provided with a pump for conveying the electrolyte from the reserve container into the treatment tank.

In the process according to the invention, the duration of the anodic oxidation, i.e. the time during which a point of the material surface is within the sphere of influence of the electrode(s), is appropriately in the range between 5 and 60 seconds, preferably between 10 and 35 seconds. In this manner, the weight of the aluminum oxide layer obtained may range from 1 to 10 $g/m^2$ (corresponding to a layer thickness of about 0.3 to 3.0 μm), preferably from about 2 to about 4 $g/m^2$.

When carrying out the inventive process in practice, it is necessary to provide for a proper circulation of the electrolyte. This may be achieved by agitating or pump-circulating the electrolyte. When the continuous process is employed (see for example German Auslegeschrift No. 2,234,424) care must be taken that the electrolyte is conveyed, as far as possible, in parallel with the strip to be treated and that a turbulent electrolyte flow at high speed is produced, so that a good exchange of substances, concentration and heat is ensured. The rate of flow of the electrolyte relative to the strip is then appropriately more than 0.3 m/second. In the anodic oxidation process direct current is preferably used; it is, however, also possible to use alternating current or a combination of these kinds of current (for example, direct current with superimposed alternating current, and the like).

The process according to the invention for the anodic oxidation of aluminum may be preceded by one or more pretreating steps, particularly a roughening step—especially in the case of the application of the process to the preparation of a support material for printing plates. Pretreating includes either a mechanical surface treatment by grinding, polishing, brushing, or blast-abrasion, or a chemical surface treatment for degreasing, pickling, or producing a mat surface, or an electrochemical surface treatment by the action of electric current (usually alternating current) in an acid, for example HCl or $HNO_3$. Of these pretreating steps, especially the mechanical and the electrochemical treatment of the aluminum result in roughened surfaces. When these methods are employed, the average depth of roughening $R_z$ is in the range between about 1 and about 15 μm, particularly in the range between 4 and 8 μm.

The depth of roughening is determined in accordance with German Industrial Standard DIN 4768, October 1970 edition. Accordingly, the average depth of roughening $R_z$ is the arithmetic mean of the individual depths or roughening of five adjoining individually measured sections. The individual depth of roughening is defined as the distance of two parallel lines from a middle line between them, with the two parallel lines contacting the highest and the lowest points of the roughness profile within the individually measured section. The individually measured section corresponds to one fifth of the length of the section of the roughness profile, which is projected at a right angle onto the middle line and is directly used for evaluation. The middle line is the line which extends in parallel with the general direction of the roughness profile and which has the shape of the geometrically ideal profile and divides the roughness profile in such a manner that the sum of the areas filled with material above it and the sum of the areas free from material below it are equal.

The inventive process for the anodic oxidation of aluminum may—particularly in the case of the application of the process to the preparation of a support material for printing plates-be followed by one or more post-treating or conditioning steps. By "post-treating" or conditioning a chemical or electrochemical treatment of the aluminum oxide layer is, particularly, understood, for example, an immersion treatment of the material in an aqueous solution of polyvinyl phosphonic acid according to German Pat. No. 1,621,478, or an immersion treatment in an aqueous solution of alkali silicate according to German Auslegeschrift No. 1,471,707 (corresponding to U.S. Pat. No. 3,181,461), or an electrochemical treatment (anodization) in an aqueous solution of alkali silicate according to German Offenlegungsschrift No. 2,532,769 corresponding to U.S. Pat. No. 3,902,976). These conditioning steps serve, in particular, to improve the hydrophilic properties of the aluminum oxide layer, which are already sufficient for many fields of application, with the well-known good properties of the layer being at least maintained.

A material which has been anodically oxidized according to the inventive process and which, if appropriate, has been pretreated and/or conditioned, is particularly suitable for use as a support material for printing plates carrying a light-sensitive layer. In this case, the support material is, either at the manufacturer or presensitized printing plates or at the user, coated with one of the following light-sensitive compositions:

Basically, any light-sensitive layers are suitable which after exposure, if necessary followed by developing and/or fixing, provide an area in imagewise distribution, which may be used for printing. Apart from the layers containing silver halides, which are used in many fields of application various other layers are known, such as are described, for example, in "Light-Sensitive Systems" by Jaromir Kosar, John Wiley & Sons, New York, 1965. These include: the colloid layers containing chromates or dichromates (Kosar, Chapter 2); the layers containing unsaturated compounds, in which these compounds are isomerized, transposed, cyclized, or cross-linked during exposure (Kosar, Chapter 4); the layers containing photopolymerizable compounds, in which monomers or prepolymers are polymerized by exposure, if appropriate by means of an initiator (Kosar, Chapter 5); and the layers containing o-diazoquinones, for example, naphthoquinone-diazides, p-diazoquinones or diazonium salt condensates (Kosar, Chapter 7). Among the suitable layers are also the electrophotographic layers, i.e. layers containing an inorganic or organic photoconductor. In addition to the light-sensitive substances these layers may also naturally contain further components, for example, resins, dyes or plasticizers.

The following light-sensitive compositions or compounds may, particularly, be used for coating the support materials prepared according to the inventive process:

Positive-working o-quinone diazide compounds, preferably o-naphthoquinone diazide compounds, which are described, for example, in German Pat. Nos. 854,890; 865,109; 879,203; 894,959; 939,233; 1,109,521; 1,114,705; 1,118,606; 1,120,273; and 1,124,817.

Negative-working condensation products from aromatic diazonium salts and compounds containing active carbonyl groups, preferably condensation products from diphenylamine diazonium salts and formaldehyde, which are described, for example, in German Pat. Nos. 596,731; 1,138,399; 1,138,400; 1,138,401; 1,142,871; and 1,154,123, in U.S. Pat. Nos. 2,679,498, and 3,050,502, and in British Pat. No. 712,606.

Negative-working mixed condensation products from aromatic diazonium compounds (for example, according to German Offenlegungsschrift No. 2,024,244) which comprise at least one unit of each of the general types A $(—D)_n$ and B, which are linked by a bivalent intermediate member derived from a carbonyl compound capable of condensation; the symbols being defined as follows: A is a radical of a compound containing at least two members selected from an aromatic ring and/or a heterocyclic ring of aromatic nature, which compound is capable of condensation in at least one position with an active carbonyl compound in an acid medium. D is a diazonium salt group linked to an aromatic carbon atom of A; n is an integer from 1 to 10, and B is a radical of a compound free of diazonium groups and being capable of condensation in at least one position of the molecule with an active carbonyl compound in an acid medium.

Positive-working layers according to German Offenlegungsschrift No. 2,610,842, comprising a compound which splits-off an acid upon irradiation and a compound having at least one COC bond capable of being split by an acid (for example an orthocarboxylic acid ester group or a carboxylic acid amide acetal group) and, optionally, a binder.

Negative-working layers composed of photopolymerizable monomers, photoinitiators, binders and, optionally, further additions. The monomers used in this case are, for example, esters of acrylic or methacrylic acid, or reaction products of diisocyanates and partial esters of polyhydric alcohols, such as described, for example in U.S. Pat. Nos. 2,760,863, and 3,060,023, and in German Offenlegungsschriften Nos. 2,064,079, and 2,361,041. Suitable photoinitiators are, for example, benzoin, benzoin ethers, multi-nuclear quinones, acridine derivatives, phenazine derivatives, quinoxaline derivatives, quinazoline derivatives, or synergistic mixtures of various ketones. A great number of soluble organic polymers may be used as binders, for example, polyamides, polyesters, alkyd resins, polyvinyl alcohol, polyvinyl pyrrolidone, polyethylene oxide, gelatin, or cellulose ethers.

To sum up, it can be said that the process according to the invention surprisingly may be used to prepare anodically oxidized strip, foil, or sheer-shaped materials of aluminum or aluminum alloys, which have an abrasion-resistant, alkali-resistant, and low-porosity surface of adequate thickness for many applications. Especially, a support material for printing plates prepared according to this process and coated with a light-sensitive layer does not show any or, at least, only a minor degree of "staining". In the inventive process it is possible to achieve this object by a combination of process features which, in the opinion of experts, are rather detrimental to the attainment of this object, namely the use of $H_2SO_4$ in a weak concentration, $Al^{3+}$ ions in a strong concentration, a relatively high temperature of the electrolyte, a high current density, and a high flow rate of the electrolyte. Although individual features of the process may have become known in certain branches, this does not apply to the combination of all of these features. In spite of the relatively high temperature of the electrolyte, the capability of the electrolyte to redissolve particular layer components is within the range of values normally observed with lower electrolyte temperatures. Also, "burns" of the aluminum oxide, which are frequently feared in the case of a higher current density do not occur.

In the following examples the percentages given are related to weight, and the relationship between parts by weight and parts by volume is the same as that of the kilogram to the liter. When evaluating the aluminum materials which had been anodically oxidized according to the inventive process, the following standard methods were used:

Determination of the weight per unit area of aluminum oxide layers by chemical dissolution (according to German Industrial Standard DIN 50944, March 1969 edition):

A solution composed of 37 ml of $H_3PO_4$ (density 1.71 g/ml at 20° C., corresponding to 85% concentration $H_3PO_4$), 20 g of $CrO_3$, and 963 ml of distilled $H_2O$ is used to dissolve the aluminum oxide layer from the base metal, at a temperature of from 90° to 95° C., during 5 minutes. The resulting loss of weight is determined by weighing the sample prior to and after dissolving the layer. The loss of weight and the weight of the surface covered by the layer are then taken to calculate the weight per unit area of the layer, which is given in $g/m^2$.

Testing the quality of the sealing of oxide layers produced in an anodization process by staining with dyes (based on German Industrial Standard DIN 50946, June 1968 edition):

This qualitative measuring method, particularly when used in combination with an ensuing quantitative determination of the color stimulus specification, indicates whether and to what extent the anodically oxidized surface of an aluminum material tends to "stain". For the purpose of measurement, one half of a planar piece of material of 5 cm × 12 cm is, during 20 minutes, immersed in a solution of 0.5 g/l of aluminum blue (®Solway Blue BN 150 of ICI) in distilled $H_2O$, at a temperature ranging from 40° to 45° C.; it is then rinsed with distilled water and dried. The degree of staining is a measure of the quality of the sealing. The lower the amount of dyestuff absorbed, the better the sealing, i.e., the lower the susceptibility of the tested surface to "staining".

Determination of the color stimulus specification (according to DIN 5033, Sheet 1 of July 1962; Sheet 3 of April 1954; Sheet 6 of September 1964; and Sheet 7 of October 1966):

In this method the color coefficients for the unstained and the stained portions of a sample (stained with aluminum blue) are determined. Standard illuminant C (spectral distribution of radiation of a gas-filled tungsten incandescent lamp of distribution temperature 2854K) is used to determine the three coefficients of the color stimulus specification to be determined. As the result, the trichromatic coefficients of the standard stimulus system can be given, however, in practice (at least in the present case) it is often sufficient to specify one standard tristimulus value or standard chromaticity coordinate only. In determining the color stimulus specification of the sample the difference between the standard chromaticity coordinates $X_I$ of the unstained portion of the sample and $X_{II}$ of the stained portion of the sample is a measure of the sealing of the surface, i.e. the higher the value of the difference, the lower the density of the surface and the sooner "staining" will occur.

Testing the resistance to alkali of the surface (according to U.S. Pat. No. 3,940,321, column 3, lines 29 to 68 and column 4, lines 1 to 8):

The rate of dissolving in seconds of an aluminum oxide layer in an alkaline zincate solution is a measure of the alkali resistance of the layer. The longer the time required by the layer to dissolve, the higher its alkali-resistance. The thicknesses of the layers should be approximately comparable, because they are naturally also a parameter of the rate of dissolving. A drop of a solution composed of 500 ml of distilled water, 480 g of KOH, and 80 g of zinc oxide is applied to the surface to be tested, and the time taken for the metallic zinc to appear is measured, which is shown by a black staining of the area tested.

The invention will be further illustrated by reference to the following specific examples:

EXAMPLE 1

Bright-rolled aluminum strip having a thickness of 0.3 mm is degreased in an alkaline pickling solution (an aqueous solution containing 20 g of NaOH per liter of the solution) at a temperature of about 50° to 70° C. Electrochemical roughening of the aluminum surface is carried out in an apparatus constructed according to the teaching of German Auslegeschrift No. 2,234,424, using A.C. and an electrolyte containing $HNO_3$. A similar apparatus is employed for the subsequent anodic oxidation using D.C.; current is then, however, supplied by way of a contact roller.

The anodizing electrolyte contains 50 g of $H_2SO_4$ per liter and 20 g of $Al^{3+}$ per liter, the $Al^{3+}$ ion concentration being obtained by dissolving 247 g of $Al_2(SO_4)_3 \cdot 18 H_2O$ per liter. At a temperature of the bath of 40° C. and a current density of 10 A/dm$^2$ (D.C.) about 2.9 g/m$^2$ of aluminum oxide may be built up during an anodizing time of about 25 seconds. In order to achieve a good exchange of substances, concentrations and heat, a turbulent flow is produced in the above-mentioned apparatus; the rate of flow of the electrolyte exceeds 0.3 m/second.

A presensitized printing plate is prepared from this material by coating it with a solution having the following components:

| | |
|---|---|
| 0.58 part by weight | of the esterification product of 1 mole of 2,2'-dihydroxy-dinaphthyl-(1,1')-methane and 2 moles of the chloride of naphthoquinone-(1,2)-diazide-(2)-5-sulfonic acid, |
| 1.16 parts by weight | of the p-cumyl phenol ester of naphthoqinone-(1,2)-diazide-(2)-4-sulfonic acid, |
| 6.92 parts by weight | of a novolak resin (softening range from 112 to 118° C., content of phenolic OH groups 14 percent by weight), |
| 0.08 part by weight | of Crystal Violet base, |
| 0.26 part by weight | of the chloride of naphthoquinone-(1,2)-diazide-(2)-4-sulfonic acid, |
| 36.0 parts by weight | of ethylene glycol monoethyl ether, |
| 47.00 parts by weight | of tetrahydrofuran, and |
| 8.00 parts by weight | of butyl acetate. |

The weight of the light-sensitive layer applied to the anodized support is about 3 g/m$^2$.

A printing form is prepared by exposing the plate in known manner, followed by developing in an aqueous alkaline solution. Between 150,000 and 180,000 prints of good quality may be produced in the offset method from the resulting printing form.

The susceptibility to "staining" of the printing plate is measured by staining the plate prior to the application of the light-sensitive layer.

When determining the color stimulus specification a difference of the chromaticity coordinates $X_I - X_{II} = 6.4 \cdot 10^3$ is obtained as a measure of the absorption of dyestuff by the surface.

The zincate test results in a measuring time of about 35 seconds. The printing plate support shows only a small degree of "staining", and it has a good resistance to alkali.

EXAMPLE 2

Bright-rolled aluminum strip having a thickness of 0.3 mm is pickled in an alkaline solution and roughened as specified in Example 1. The ensuing anodic oxidation is carried out in an apparatus constructed according to the teaching of German Auslegeschrift No. 2,234,424, using an electrolyte which contains 100 g of $H_2SO_4$ per liter and 20 g of $Al^{3+}$ per liter. At a temperature of the bath of 35° C. and a current density of 10 A/dm$^2$, 3 g/m$^2$ of aluminum oxide may be built up in 25 seconds.

The staining test results in a difference of the chromaticity coordinates $X_I - X_{II} = 18 \cdot 10^3$; and the zincate test results in a measuring time of 24 seconds.

Following the application of a light-sensitive layer according to Example 1, between 150,000 and 180,000 prints of good quality may be obtained in the offset method.

The printing plate support shows only a small degree of "staining", and it has a good resistance to alkali.

EXAMPLE 3

Bright-rolled aluminum strip having a thickness of 0.3 mm is pickled in an alkaline solution and electrochemically roughened as specified in Example 1. Anodic oxidation is carried out in an apparatus constructed according to the teaching of German Auslegeschrift No. 2,234,424. The electrolyte contains 30 g of $H_2SO_4$ per liter and 15 g of $Al^{3+}$ per liter. At a temperature of the bath of 35° C. and a current density of 5 A/dm$^2$ an aluminum oxide layer of about 2.3 g/m$^2$ may be built up in 30 seconds. The staining test results in a difference of the chromaticity coordinates $X_I - X_{II} = 5 \cdot 10^3$, and the zincate test results in a measuring time of 55 seconds.

After coating with a light-sensitive solution according to Example 1 more than 100,000 offset prints of good quality may be produced. The degree of "staining" of the printing plate support is very small, and it has a good resistance to alkali.

If the temperature of the bath is increased to 55° C. and the current density to 9 A/dm$^2$, about 3 g/m$^2$ of aluminum oxide may be built up. In the staining test the difference of the chromaticity coordinates is only slightly increased to $X_I - X_{II} = 8 \cdot 10^3$. The measuring time in the zincate test is increased to about 77 seconds. This unpredictable improvement of the resistance to alkali at higher temperatures of the bath is a clear evidence of the practical value of the invention.

Following coating of the plate with the solution described in Example 1 about 170,000 prints of good quality may be produced in the offset method. The exposed and developed printing form shows only a very small degree of "staining".

EXAMPLE 4

Bright-rolled aluminum strip is pretreated and anodically oxidized as described in Example 1. However, anodic oxidation is carried out in an electrolyte containing 75 g of $H_2SO_4$ per liter and 20 g of $Al^{3+}$ per liter.

At a temperature of the bath of 40° C. and a current density of 9 A/dm$^2$ about 2.5 g/m$^2$ of aluminum oxide may be built up. The staining test results in a difference of the chromaticity coordinates $X_I - X_{II} = 16 \cdot 10^3$, and in the zincate test 32 seconds are measured.

After coating the plate with the solution described in Example 1, about 150,000 prints of good quality may be produced from the exposed and developed plate.

The printing plate support shows only a small degree of "staining", and it has good resistance to alkali.

EXAMPLE 5 (COMPARATIVE EXAMPLE)

Pieces of aluminum strip are pickled in an alkaline solution and electrochemically roughened in $HNO_3$ using the tank method, similar to the description given in German Auslegeschrift No. 1,238,049. Anodic oxidation is carried out in a tank with aluminum or graphite serving as the cathode material. Circulation and temperature control of the bath are achieved by pump circulating via a heating/cooling system. At a concentration of 125 g of $H_2SO_4$ per liter and a maximum concentration of 7 g of $Al^{3+}$ per liter, about 2.5 to 3 g/m$^2$ of aluminum oxide are produced in 180 seconds, at a current density of 2.5 A/dm$^2$ and a temperature of 40° C.

The staining test results in a difference of the chromaticity coordinates $X_I - X_{II} = 36 \cdot 10^3$.

In the zincate test, the aluminum oxide thus produced withstands the attack of the alkaline solution for 20 seconds only.

Following coating with a solution according to Example 1 and after exposure and development, the support of the printing form shows a high degree of "staining". That is to say that at a stronger concentration of $H_2SO_4$ and a weaker concentration of $Al^{3+}$ ions than prevailing in the process according to the invention it is impossible to produce comparably good aluminum oxide layers.

EXAMPLE 6 (COMPARATIVE EXAMPLE)

Aluminum strip having a thickness of 0.3 mm is pickled in an alkaline solution, electrochemically roughened, and anodically oxidized as specified in Example 1. Anodic oxidation is, however, carried out in an electrolyte containing 150 g of $H_2SO_4$ per liter and 5 g of $Al^{3+}$ per liter.

At a temperature of the bath of 40° C. and a current density of 12 A/dm$^2$ about 2.8 g/m$^2$ of aluminum oxide may be built up in about 30 seconds.

The staining test results in a difference of the chromaticity coordinates $X_I - X_{II} = 27 \cdot 10^3$. In the zincate test the oxide layer is already penetrated after 22 seconds.

Following coating with a solution according to Example 1 a printing plate is obtained which shows a high degree of "staining" after exposure and development. About 140,000 good prints may be produced in the offset method.

If, in the anodic oxidation procedure, the temperature is increased to 55° C. and the current density to 16 A/dm$^2$, about 3.4 g/m$^2$ of oxide may be produced. In this case, the difference of the chromaticity coordinates $X_I - X_{II}$ determined in the staining test increases to $42 \cdot 10^3$, while the resistance in the zincate test decreases to 16 seconds. Example 3, on the other hand, shows the improvement which may be obtained according to the present invention with respect to the staining test (i.e. reduced degree of "staining") and the resistance to alkali, at likewise increased temperature and current density.

The support provided with a light-sensitive coating according to Example 1 exhibits a very high degree of "staining" after exposure and development. About 95,000 prints of good quality only may be produced in the offset method.

EXAMPLE 7

Bright-rolled aluminum strip having a thickness of 0.3 mm is degreased in an alkaline solution, electrochemically roughened and anodically oxidized as specified in Example 1. The electrolyte used in the anodic oxidation procedure contains 50 g of $H_2SO_4$ per liter and 20 g of $Al^{3+}$ per liter. At a temperature of the bath of 40° C. and a current density of 10 A/dm$^2$ about 3 g/m$^2$ of oxide may be built up in 25 seconds.

The aluminum support is then during 4 minutes immersed into a 0.1% by weight aqueous solution of polyvinyl phosphonic acid (molecular weight about 100,000) having a temperature of 60° C., to prepare the surface for the subsequent sensitizing. The light-sensitive coating applied has the following composition: 1.4 parts by weight of a mixed condensate of 1 mole of 3-methoxydiphenylamine-4-diazonium sulfate and 1 mole of 4,4'-bis-methoxy-methyl diphenyl ether, prepared in a 85% by weight aqueous phosphoric acid and precipitated as the mesitylene sulfonate, 0.2 part by weight of p-toluene sulfonic acid monohydrate, 3 parts by weight of polyvinyl butyral (containing from 69 to 71% of polyvinyl butyral units, 1% of polyvinyl acetate units, and from 24 to 27% of polyvinyl alcohol units, the viscosity of a 5% by weight solution in butanol at 20° C. ranging between 20 and 30 mPa·s), 80 parts by volume of ethylene glycol monomethyl ether and 20 parts by volume of butyl acetate. The diazo-mixed condensate layer is exposed under a negative and is then developed using a mixture of 50 parts by weight of water, 15 parts by weight of isopropanol, 20 parts by weight of n-propanol, 12.5 parts by weight of n-propyl acetate, 1.5 parts by weight of polyacrylic acid, and 1.5 parts by weight of acetic acid.

The printing form thus obtained allows the production of very good prints. The image-free areas are free from "staining". Oxide layers prepared according to the invention, therefore, enable an unrestricted application of the methods and chemicals which are conventionally employed for improving the behavior of negative layers.

EXAMPLE 8

A roughened aluminum strip prepared as described in Example 1 is anodically oxidized in an electrolyte containing 30 g of $H_2SO_4$ per liter and 15 g of $Al^{3+}$ per liter. At a temperature of the bath of 55° C. and a current density of 8 A/dm$^2$ from 2.7 to 3 g/m$^2$ of aluminum oxide may be built up in 30 seconds. The staining test results in a difference of the chromaticity coordinates $X_I - X_{II} = 12 \cdot 10^3$, and the time measured in the zincate test is about 69 seconds.

The light-sensitive coating applied may be composed of a positive-working solution, as described in Example 1, but also of a negative-working photopolymeric solution having the following components:

| | |
|---|---|
| 1.4 parts by weight | of a copolymer of methyl methacrylate and methacrylic acid having an average molecular weight of 36,000 and an acid number of 95, |
| 1.4 parts by weight | of pentaerythritol triacrylate, |
| 0.05 part by weight | of 9-phenyl-acridine, |
| 0.2 part by weight | of 1,6-dihydroxy ethoxy hexane, |
| 0.02 part by weight | of the phenazine dye "Supranol Blue GL", and |
| 16.0 parts by weight | of methyl ethyl ketone. |

The aluminum support coated with 5 g/m$^2$ of this photopolymeric layer is additionally provided with a covering layer of about 1 g/m$^2$, which is prepared from the following solution:

| | |
|---|---|
| 2.0 parts by weight | of cane sugar, |
| 1.0 part by weight | of methyl cellulose having an average viscosity of 50 c Pa . s, and |
| 0.15 part by weight | of saponin in |
| 96.85 parts by volume | of water. |

Following exposure and development in the manner described in German Patent No. 1,193,366, a printing form is obtained which is free from "staining" in the image-free areas and yields long press runs.

EXAMPLE 9

An aluminum strip is pretreated and roughened as specified in Example 1. Anodizing is carried out in an electrolyte containing 100 g of $H_2SO_4$ per liter and 20 g of $Al^{3+}$ per liter. At a temperature of the bath of 40° C. and a current density of 10 A/dm$^2$ about 3 g/m$^2$ of aluminum oxide may be produced in about 30 seconds. In the staining test this oxide shows a difference of the chromaticity coordinates $X_I - X_{II} = 24 \cdot 10^3$.

A light-sensitive coating is applied in the form of a negative-working solution having the following composition:

| | |
|---|---|
| 100 parts by volume | of glycol monomethyl ether, |
| 0.75 part by weight | of benzoquinone-(1,4)-diazide-(4)-2-sulfonic acid naphthylamide, |
| 0.75 part by weight | of N-(4'-methyl benzene sulfonyl)-imino-2,5-diethoxybenzoquinone-(1,4)-diazide-4, |
| 0.02 part by weight | of Crystal Violet base, and |
| 0.5 part by weight | of a resin prepared in the following manner: |

100 g of finely powdered novolak are slowly added to a solution of 36 g of NaOH in 500 ml of water at 50° C. When the novolak has dissolved, the solution is brought to boil and is mixed with 125 g of powdered Na-monochloroacetate in the course of about 20 minutes. Boiling is then continued for about 1.5 hours. A turbidity which may arise is eliminated by adding the smallest possible amount of NaOH. The reaction mixture is then diluted with double the amount of water at 40° C., and is subsequently rendered weakly acid by adding hydrochloric acid (1:2). The precipitated resin is filtered, thoroughly extracted with water and dried at a temperature of 110° C. Approximately 100 g of a resin are obtained, which contains from 10 to 11% of carboxyl groups, corresponding to a degree of esterification ranging from 30 to 34%.

The coated aluminum support is dried and subsequently exposed under a negative film original. The image is developed using a solution of 2 parts by weight of trisodium phosphate and 4 parts by weight of disodium phosphate in 100 parts by volume of water. After development the printing form is rinsed with water and wiped over on the image side with a 1% by weight aqueous phosphoric acid. It is then inked with a greasy ink. The printing form thus obtained is of good quality in the image-free areas, i.e., it is free from scumming, clearable, and free from "staining". It may be used to produce about 55,000 offset prints of good quality.

A support prepared according to Example 6, on the other hand, which is coated in a similar manner with this light-sensitive composition and is exposed as described above, cannot be developed so as to be free from scumming, i.e., in the image-free areas the non-hardened light-sensitive layer can be only incompletely removed from the support by means of a developer.

It will be obvious to those skilled in the art that many modifications may be made within the scope of the present invention without departing from the spirit thereof, and the invention includes all such modifications.

What is claimed is:

1. In the process for anodically oxidizing materials in the form of strips, foils, or sheets comprised of aluminum or aluminum alloys in an aqueous electrolyte containing sulfuric acid and aluminum ions, if appropriate, after a foregoing mechanical, chemical, or electrochemical roughening, the improvement comprising anodically oxidizing the material in an electrolyte having a concentration of sulfuric acid in the range of about 25 to 100 g per liter and of aluminum ions in the range of about 10 to 25 g per liter, at a current density in the range of about 4 to 25 A/dm$^2$, and a temperature in the range of about 25° to 65° C.

2. A process according to claim 1 in which the material is anodically oxidized in an electrolyte having a concentration of sulfuric acid in the range of about 30 to 75 g per liter and of aluminum ions in the range of about 15 to 20 g per liter, at a current density in the range of about 6 to 15 A/dm$^2$, and a temperature in the range of about 40° to 55° C.

3. In the process for the preparation of a support material for printing plates in the form of a strip, a foil, or a sheet, by anodically oxidizing aluminum or an aluminum alloy in an aqueous electrolyte containing sulfuric acid and aluminum ions, if appropriate, after a foregoing mechanical, chemical or electrochemical roughening, the improvement comprising anodically oxidizing the support material in an electrolyte having a concentration of sulfuric acid in the range of about 25 to 100 g per liter and of aluminum ions in the range of about 10 to 25 g per liter, at a current density in the range of about 4 to 25 A/dm$^2$, and a temperature in the range of about 25° to 65° C.

4. A process according to claim 3 in which the support material is anodically oxidized in an electrolyte having a concentration of sulfuric acid in the range of about 30 to 75 g per liter and of aluminum ions in the range of about 15 to 20 g per liter, at a current density in the range of about 6 to 15 A/dm$^2$, and a temperature in the range of about 40° to 55° C.

* * * * *